US010070670B2

(12) United States Patent
Eilemberg

(10) Patent No.: US 10,070,670 B2
(45) Date of Patent: Sep. 11, 2018

(54) STRAPLESS AND BACKLESS BRA

(71) Applicant: Nicole Garland Eilemberg, La Jolla, CA (US)

(72) Inventor: Nicole Garland Eilemberg, La Jolla, CA (US)

( * ) Notice: Subject to any disclaimer, the term of this patent is extended or adjusted under 35 U.S.C. 154(b) by 0 days.

(21) Appl. No.: 15/294,624

(22) Filed: Oct. 14, 2016

(65) Prior Publication Data

US 2017/0105459 A1 Apr. 20, 2017

Related U.S. Application Data

(60) Provisional application No. 62/242,109, filed on Oct. 15, 2015.

(51) Int. Cl.
*A41C 3/06* (2006.01)
*A41C 3/00* (2006.01)

(52) U.S. Cl.
CPC ..... *A41C 3/065* (2013.01); *A41C 3/0007* (2013.01); *A41C 3/0078* (2013.01)

(58) Field of Classification Search
CPC .. A41C 3/00; A41C 3/10; A41C 3/065; A41C 3/06; A41C 3/005; A41C 3/0064
USPC ..... 450/36, 37, 54–57, 81, 88
See application file for complete search history.

(56) References Cited

U.S. PATENT DOCUMENTS

| | | | | |
|---|---|---|---|---|
| 7,163,433 | B2 * | 1/2007 | Chou | A41C 3/065 2/267 |
| 8,936,504 | B2 * | 1/2015 | Deal | A41C 3/065 450/39 |
| 2004/0022984 | A1 * | 2/2004 | Abe | C08G 18/4277 428/40.1 |
| 2009/0149114 | A1 * | 6/2009 | Horton | A41C 3/065 450/54 |
| 2013/0316616 | A1 * | 11/2013 | Thompson | A41F 15/002 450/66 |
| 2014/0248822 | A1 * | 9/2014 | Abbott | A41F 9/00 450/1 |
| 2015/0208737 | A1 * | 7/2015 | Nevins | A41D 1/22 2/74 |

* cited by examiner

*Primary Examiner* — Gloria Hale
(74) *Attorney, Agent, or Firm* — Procopio, Cory, Hargreaves & Savitch LLP

(57) ABSTRACT

Some embodiments of the invention include a backless and strapless bra including a pair of cups, each cup configured to accommodate a user's breast. The cups of this bra are made with a four way stretch material used to lift each breast. Each cup may include a bottom edge configured to align with a bottom portion of the user's breast, a top edge configured to align with a top portion of the user's breast, an adhesive layer, a backing layer, and optionally a fastener configured to engage with a complimentary fastener on the other cup.

15 Claims, 2 Drawing Sheets

STRAPLESS AND BACKLESS BRA

CROSS-REFERENCE TO RELATED APPLICATION

This application claims the benefit of U.S. Provisional Patent Application No. 62/242,109, filed Oct. 15, 2015, entitled "STRAPLESS AND BACKLESS UNDERWIRE BRA", the contents of which are hereby incorporated by reference in their entirety.

BACKGROUND

The embodiments described herein relate to apparel and, more particularly, to a strapless and backless bra with lift support.

When wearing a strapless, backless, and/or low V-neck top, it is very difficult to conceal a bra that offers sufficient support. Conventional strapless and backless bras adhere to the skin only from (1) side tabs, or (2) the entire cup, however the currently used adhesive does not last or alternatively is so strong that it cannot be removed easily. On many of the existing strapless bras the cups are not flexible, often causing the bra to fit incorrectly. These cups often slip out of pace and never properly lift the breasts to hold them into place. The current backless strapless bras that are composed of separate cups (not joined together in the middle) are intended for low cut garments but are limited because they cannot be concealed under styles of garments that also expose the underarm, the side of the breast area, and/or the area above the breast. The current invention offers support in all of these situations, it is an all-in-one solution. Conventional strapless and backless bras that include an underwire typically include a very rigid underwire, which does not conform to a user's breasts, causing discomfort and insufficient support. Moreover, current strapless backless bras do not support large breasts over a D cup in size.

Therefore, what is needed is a strapless and backless bra that conforms to a user's chest while simultaneously providing ample support, lift, and comfort. There is further a need for a strapless backless bra that will not slip out of place or shift and is easily applied and removed.

SUMMARY

Some embodiments of the invention include a backless and strapless bra including a pair of cups, each cup configured to accommodate a user's breast. Each cup may include a front side, a back side, a bottom edge configured to align with a bottom portion of the user's breast, a top edge configured to align with a top portion of the user's breast, an adhesive backing on the inside surface of each of the cups, a backing layer on the inside surface of each cup and laying on top of the adhesive layer, and optionally a fastener configured to engage with a complimentary fastener on the other cup. Each cup is manufactured with a four way stretching material with strong elastic resistance and recoil of varying grades which enables it to hold and lift the breasts. This bra will work for users with small to large breasts of any size.

BRIEF DESCRIPTION OF THE FIGURES

Having thus described the invention in general terms, reference is now made to the accompanying figures, which show different views of different example embodiments.

Figure 1:
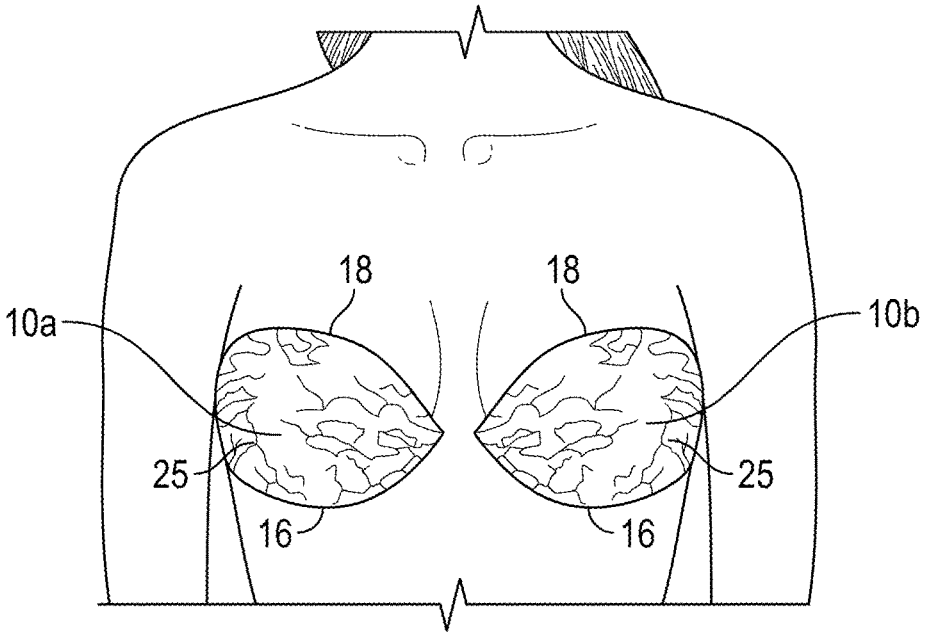
Figure 2:
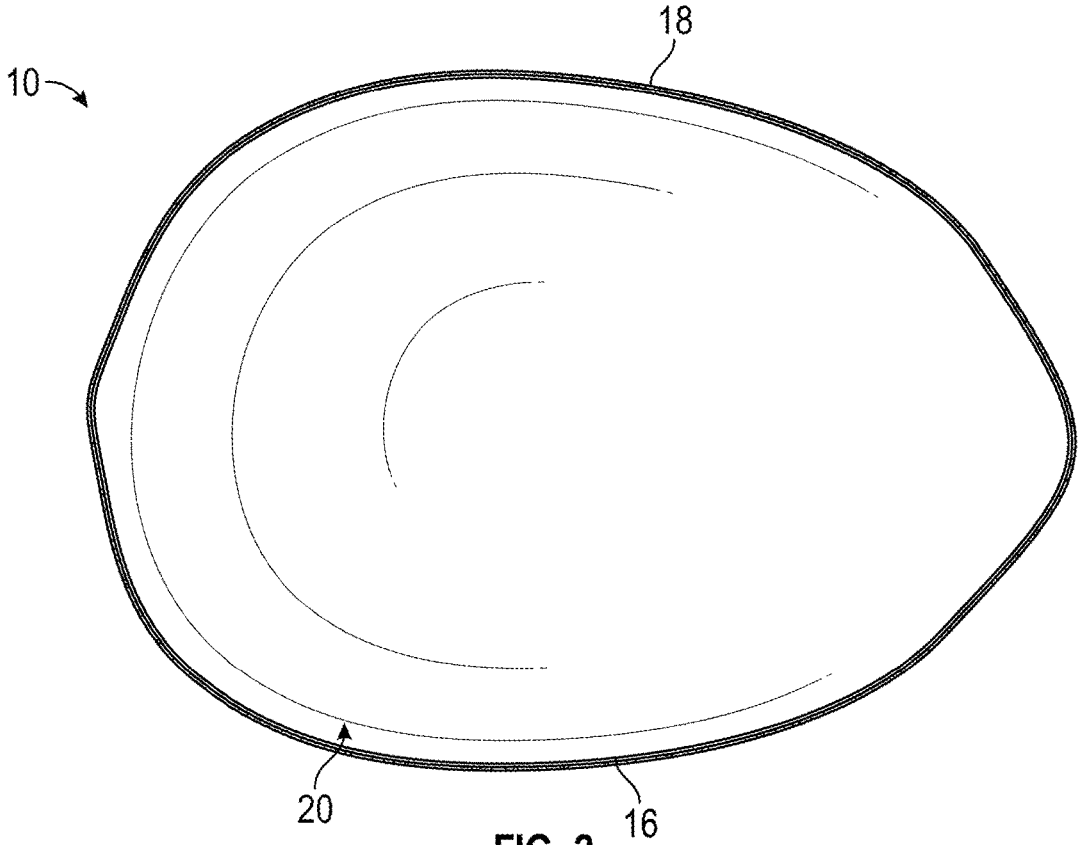
Figure 3:
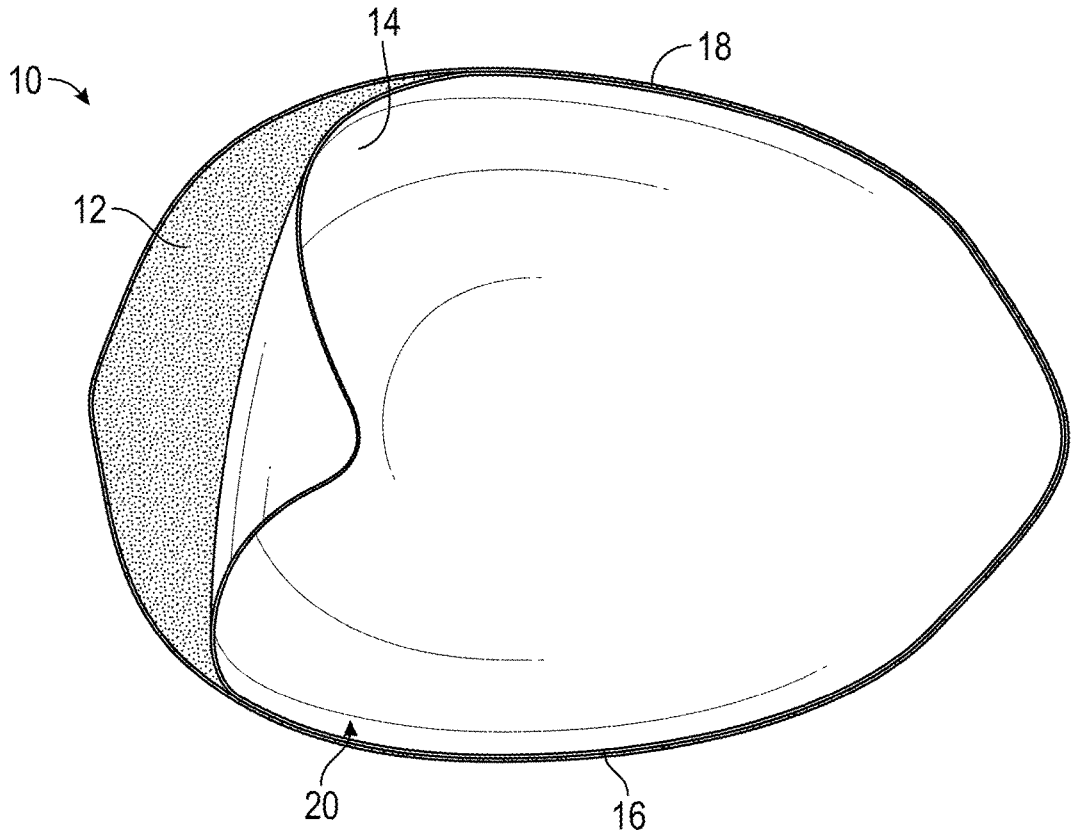
Figure 4:
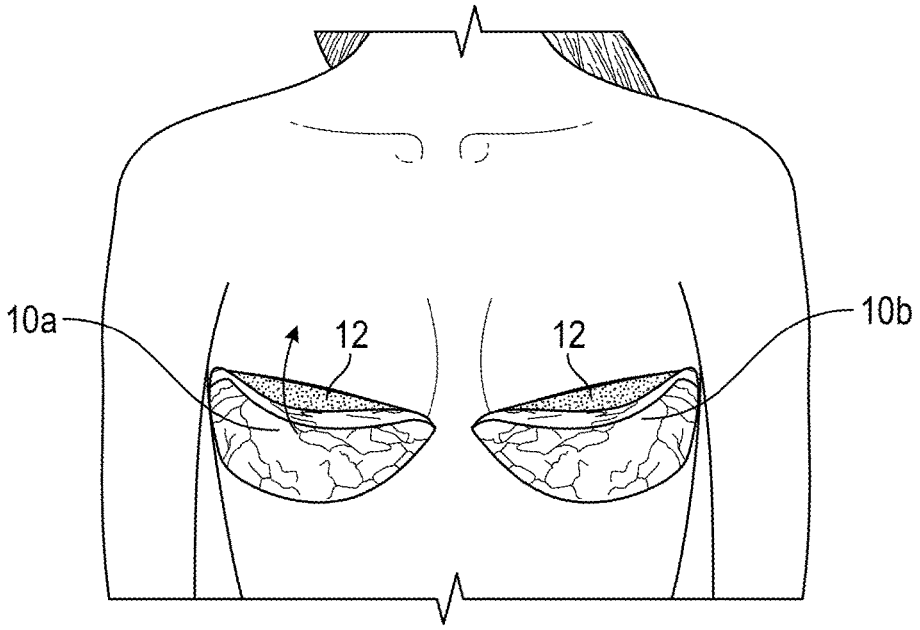

FIG. 1 is a front elevational view of one embodiment of the strapless bra being worn by a user;

FIG. 2 is an inside elevational view of one of the cups of the strapless bra;

FIG. 3 is an inside elevational view of one of the cups of the strapless bra showing the backing layer being pulled back to expose the adhesive layer;

FIG. 4 is a front elevational view of one embodiment of a strapless bra being worn by a user and showing how it is applied from bottom to top;

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a strapless and backless bra to provide ample support and comfort to human users of all sizes and may be comprised of the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Two cups made of a breathable four way stretching material with strong elastic resistance and recoil properties;
2. Adhesive; and
3. Backing layer.

The various elements of the device of the present invention may be related in the following exemplary fashion. It is not intended to limit the scope or nature of the relationships between the various elements and the following examples are presented as illustrative examples only.

By way of example, and referring to FIGS. 1-4, some embodiments of the invention include a backless and strapless bra comprising a pair of cups 10*a* and 10*b*, each cup configured to accommodate a user's breast, wherein the cups 10*a* and 10*b* do not attach to a strap configured to encircle a user's back or torso or to shoulder straps configured to go over a user's shoulders. Thus, the bra of the present disclosure is backless and strapless. This bra is to be worn by a human user with breasts of any size. The cups can be made in various shapes to allow them to function with various clothing types and cuts. Each cup 10 may comprise a bottom edge 16 and a top edge 18, an inside surface 20 and outside surface 25, an adhesive layer 12 (FIGS. 2 and 3) and a backside layer 14 (FIG. 2). Wherein the inside surface 20 of the cup 10 has an adhesive layer 12 positioned on the inside surface 20 of each cup. In some embodiments the adhesive layer 12 covers the entire inside surface 20 of each cup. In other embodiments the adhesive layer 12 only covers a portion of the inside surface 20 of each cup. Covering the entire adhesive layer 12 is a backing layer 14.

The backing layer covers the entire surface of the adhesive layer 12 and is made of a non-stick material. This layer protects the inside surface 20 of the cups 10*a* and 10*b* before the bra is used. When the bra is applied this backing layer 14 is easily peeled off the adhesive layer 12 so that the cups 10*a* and 10*b* can be applied to the user's breasts. In one embodiment the adhesive layer 12 is made of a modified-acrylic pressure-sensitive adhesive formula with a flexible interior which is between one and three millimeters of thickness. In an alternate embodiment the adhesive layer 12 is composed of 55% to 65% ethyl acetate and 35% to 45% acrylic polymer. The adhesive layer can be between 0.1 millimeter and 5 millimeters of thickness. This adhesive layer 12 is hypoallergenic. The adhesive layer 12 adheres each cup firmly to the breast and forms a stronger bond as the body heats up, even with perspiration and physical activity the cups stay firmly in place and attached. The adhesive does not come loose when the user wears the cups and maintains its strength to lift the user's breasts throughout the time it is being worn.

Referring to FIGS. 3 and 4, in order to use the bra the user removes the backing layer 14 from the first cup 10*a* by peeling it off to expose the adhesive layer 12. Once the backing layer 14 is removed, the bottom edge 16 of the cup is placed and adhered on the bottom side of the first breast FIG. 4, the user then needs to lift their breast and pull the cup 10 up over the breast and adhere the top edge 18 to the top side of the breast while lifting the breast tissue. The cups 10*a* and 10*b* will lift and hold the breasts of users of any size or shape. Once the cup 10 is adhered to the top of the breasts they will hold the breasts in the lifted position. The user is able to apply the cups and chose their desired lift. Once the cup is in place it will hold the breast firmly in place until the cup is removed. The process above is repeated for the second breast with the second cup 10*b*.

In an alternative embodiment the bottom edge 16 of each cup 10 may also comprise an underwire secured thereto. For example, in some embodiments, the underwire in on the bottom edge 16 and this bottom edge 16 has a channel configured to accommodate the underwire, wherein the underwire may be permanently secured within the channel. The underwire may help provide structure and rigid support to the bottom edge 16 of the cup 10.

Each cup 10 is comprised of a stretchy and light-weight material, wherein the material has enough give so that it can be stretched to provide the needed or desired support and lift without interfering with the adhesion to the user's skin. The material is preferably a four way stretch fabric with strong elastic resistance and recoil. The fabric is composed of a synthetic, stretch cloth which stretches in all four directions, side to side, and bottom to top. In one embodiment this fabric is made of fibers that include synthetic polymers primarily made of polyurethane polymers along with polymer chains made up of monomer units connected together with an amide group containing nitrogen atoms. In a preferred embodiment the fabric is made of 60% to 90% nylon and 10% to 40% LYCRA® spandex with an approximate weight of 200 to 210 grams per square meter. This fabric can stretch to over 200% of its resting length with no restrictive end point. This fabric is designed to absorb the load of the breast and reuse this energy back into lifting the breasts once adhered to the skin. This material is also breathable. For example, the cup 10 may comprise a cut of fabric that is manufactured according to specifications for shape and size of a user's breast. Thus the cups 10*a* and 10*b* can be manufactured in various sizes and shapes so they can be worn by various users. Another attribute to this invention is that the cups can be easily trimmed to shape and size with scissors.

In some embodiments, each of the cups 10 may comprise a fastener (not shown) configured to engage with a fastener on the other cup 10, such that a user may attach the two cups 10, if desired. For example, one cup 10 may comprise a small hook while the second cup 10 comprises a small loop configured to removably engage with the small hook. However, other fasteners are envisioned. Thus, the cups 10 may be connected to one another or, in other embodiments, may each be a stand-alone support for a breast.

As described above, unlike conventional backless and strapless bras, the bra of the present disclosure may not include adhesive side tabs. The cups 10*a* and 10*b* also comprise a very flexible and much less rigid material than conventional backless and strapless bras, wherein the cup 10 of the present disclosure may be breathable, whereas the conventional bras are not.

To use the bra of the present disclosure, a user may apply the cup 10 to the breast as described above, aligning the bottom edge 16 in the desired position along the bottom of the breast and stretch the cup up over the breast to lift it into place and then securing the cup to the skin at the top of the breast to maintain the lift. The cups can be worn for a full day or longer if desired. When the user is done with the bra and wants to remove it, the cups 10*a* and 10*b* can be easily pulled off. The adhesive used in this invention does not stick to the skin and will not leave a residue. Furthermore, the adhesive will not pull or rip the skin when the cups are removed.

The accompanying claims and their equivalents are intended to cover such forms or modifications as would fall within the scope and spirit of the protection. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A backless and strapless bra comprising:

a first breathable cup configured to accommodate a first breast of a user;

a second breathable cup configured to accommodate a second breast of a user;

the first breathable cup comprising:

a four way stretch material comprised of 60% to 90% nylon and 10% to 40% spandex;

a bottom edge configured to align with a bottom portion of the first breast;

a top edge configured to align with a top portion of the first breast;

an inside surface comprising a pressure-sensitive adhesive layer, wherein the pressure-sensitive adhesive layer is made of a material configured to stick to the first breast; and a backing layer positioned over the adhesive layer.

2. The backless and strapless bra of claim 1, wherein the four way stretch material can stretch over 200% of its resting length with no restrictive point.

3. The backless and strapless bra of claim 1, including a fastener on the first cup configured to engage with a complimentary fastener on the second cup.

4. The backless and strapless bra of claim 1, wherein the adhesive layer is between 0.1 to 3 millimeters thick.

5. The backless and strapless bra of claim 1, wherein the adhesive layer is composed of 55% to 65% ethyl acetate and 35% to 45% acrylic polymer.

6. The backless and strapless bra of claim 1, wherein the adhesive layer is sweat resistant.

7. A backless and strapless bra comprising:

a first breathable cup configured to accommodate a first breast of a user;

a second breathable cup configured to accommodate a second breast of a user;

the first breathable cup comprising:

a four way stretch material comprised of a stretchy and light-weight material having enough give so that it can be stretched to provide a desired support of lift;

a bottom edge configured to align with a bottom portion of the first breast;

a top edge configured to align with a top portion of the first breast;

an inside surface and an outside surface wherein the inside surface has an adhesive layer, the adhesive layer being made of a material which sticks to the skin on the body of a human and forms a stronger bond as the body heats up, wherein the adhesive layer is composed of 55% to 65% ethyl acetate and 35% to 45% acrylic polymer; and a backing layer positioned over the adhesive layer.

8. The backless and strapless bra of claim 7, wherein the stretchy and light-weight material is composed of a synthetic, stretch cloth made of fibers that include synthetic polymers primarily made of polyurethane polymers along with polymer chains made up of monomer units connected together with an amide group containing nitrogen atoms.

9. The backless and strapless bra of claim 7, wherein the four way stretch material can stretch over 200% of its resting length with no restrictive point.

10. The backless and strapless bra of claim 7, including a fastener on the first cup configured to engage with a complimentary fastener on the second cup.

11. The backless and strapless bra of claim 7, wherein the adhesive layer is between 0.1 to 3 millimeters thick.

12. The backless and strapless bra of claim 7, wherein the adhesive layer is sweat resistant.

13. The backless and strapless bra of claim 7, comprising an underwire on the bottom edge.

14. The backless and strapless bra of claim 1, wherein each cup can be trimmed to shape and size with scissors.

15. The backless and strapless bra of claim 1, wherein the entire inside surface has an adhesive layer.

* * * * *